US007373686B2

(12) United States Patent
Foster et al.

(10) Patent No.: US 7,373,686 B2
(45) Date of Patent: May 20, 2008

(54) BASTING BRUSH

(75) Inventors: Gregory J. Foster, Chicago, IL (US); Robert W. Sheldon, Winnetka, IL (US)

(73) Assignee: Radio Flyer Inc., Chicago, IL (US)

( * ) Notice: Subject to any disclaimer, the term of this patent is extended or adjusted under 35 U.S.C. 154(b) by 0 days.

(21) Appl. No.: 11/385,413

(22) Filed: Mar. 20, 2006

(65) Prior Publication Data

US 2007/0006411 A1 Jan. 11, 2007

Related U.S. Application Data

(60) Provisional application No. 60/663,386, filed on Mar. 18, 2005.

(51) Int. Cl.

| | |
|---|---|
| ***A46B 1/00*** | (2006.01) |
| ***A46B 3/22*** | (2006.01) |
| ***A46B 9/02*** | (2006.01) |

(52) U.S. Cl. ..... 15/207.2; 15/188; 428/397

(58) Field of Classification Search ..... 15/186–188, 15/207.2; 428/397

See application file for complete search history.

(56) References Cited

U.S. PATENT DOCUMENTS

| | | | | |
|---|---|---|---|---|
| 2,508,799 | A * | 5/1950 | Reis, Jr. | 15/207.2 |
| 5,020,551 | A * | 6/1991 | Guerret | 132/200 |
| 6,067,684 | A * | 5/2000 | Kweon | 15/167.1 |
| 6,210,060 | B1 * | 4/2001 | Gueret | 401/129 |
| 6,390,708 | B1 * | 5/2002 | Gueret | 401/122 |
| 6,616,366 | B1 * | 9/2003 | Weihrauch | 401/286 |

* cited by examiner

*Primary Examiner*—Mark Spisich
(74) *Attorney, Agent, or Firm*—DLA Piper US LLP; R. Blake Johnston

(57) ABSTRACT

A brush for basting and applying sauces to food features a head, a handle attached to the head and a number of bristles positioned on the head. Each of the bristles features a crescent-shaped cross section.

10 Claims, 3 Drawing Sheets

BASTING BRUSH

CLAIM OF PRIORITY

This application claims priority from U.S. Provisional Patent Application Ser. No. 60/663,386, filed Mar. 18, 2005, and currently pending.

The present invention relates generally to cooking utensils and, more particularly, to a brush for basting and applying sauces to food.

DESCRIPTION OF EMBODIMENTS

Figure 1:
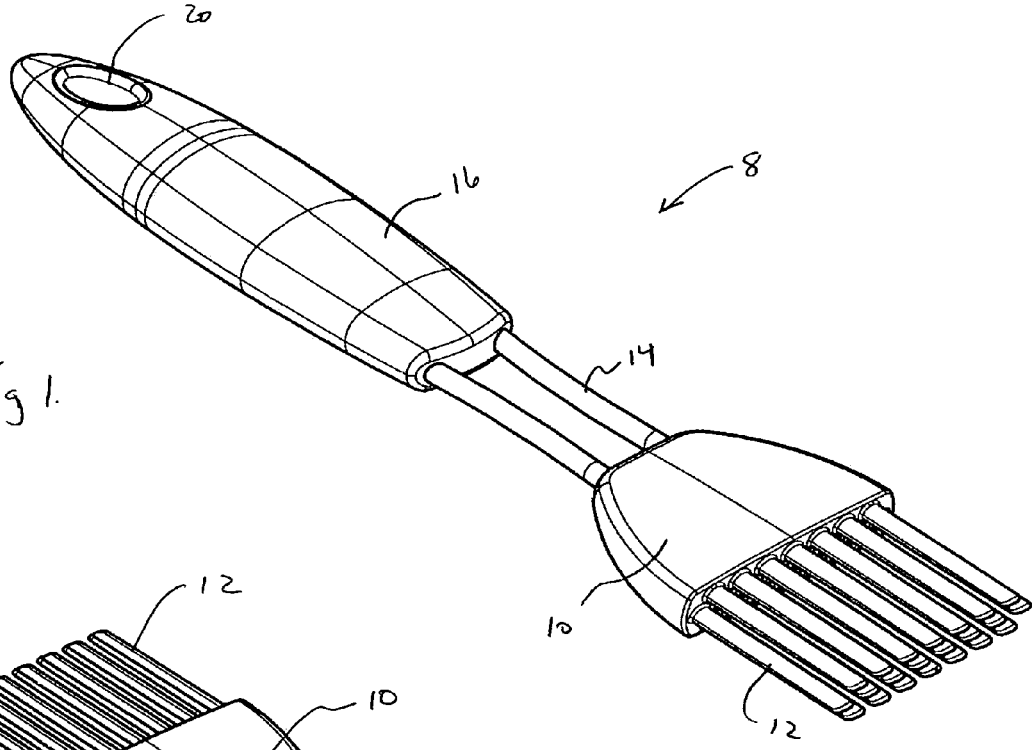
FIG. 1 is a perspective view showing the bottom and front of an embodiment of the basting brush of the present invention.
Figure 2:
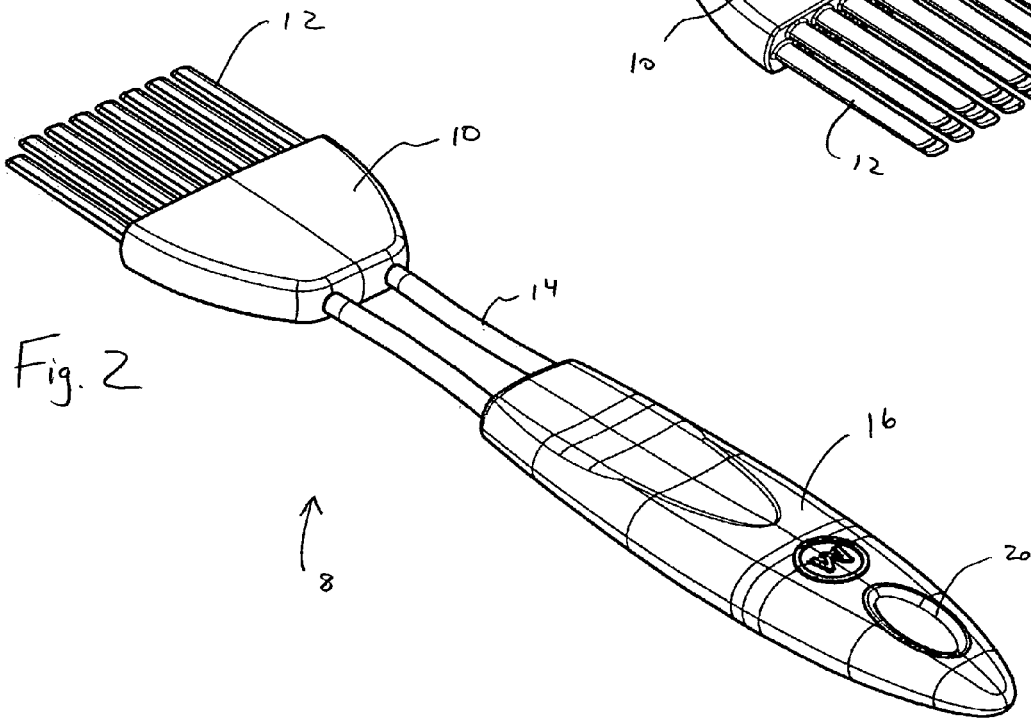
FIG. 2 is a perspective view showing the top and back of the basting brush of FIG. 1.
Figure 4:
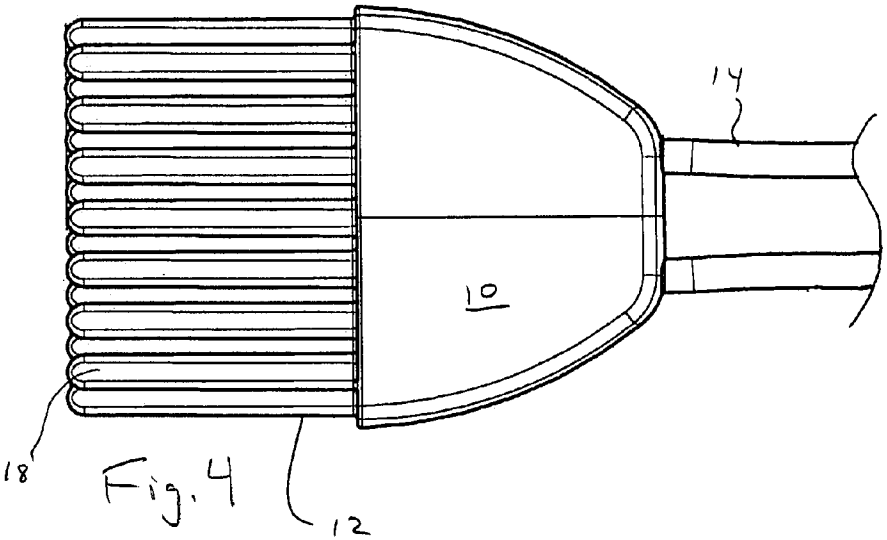
FIG. 4 is a back elevational view of the head and bristles and a portion of the handle of the basting brush of FIG. 3.
Figure 5:
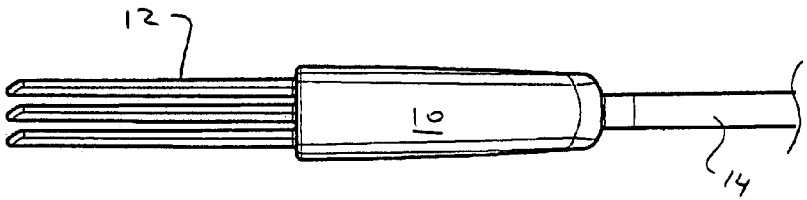
FIG. 5 is a side elevational view of the head and bristles and the portion of the handle of the basting brush of FIG. 3.

An embodiment of the basting brush of the present invention is indicated in general at 8 in FIGS. 1 and 2. The brush may be used to baste or apply sauces to food. The brush 8 features a head 10 that features a number of bristles 12. While twenty-two bristles are illustrated, the brush could feature a number of bristles more or less than that number. The brush also features a handle 14 secured to the head 10. The handle also features a grip 16.

Figure 3:
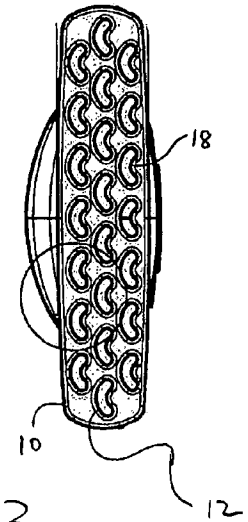
FIG. 3 is an enlarged bottom plan view of the basting brush of FIG. 1.
Figure 6:
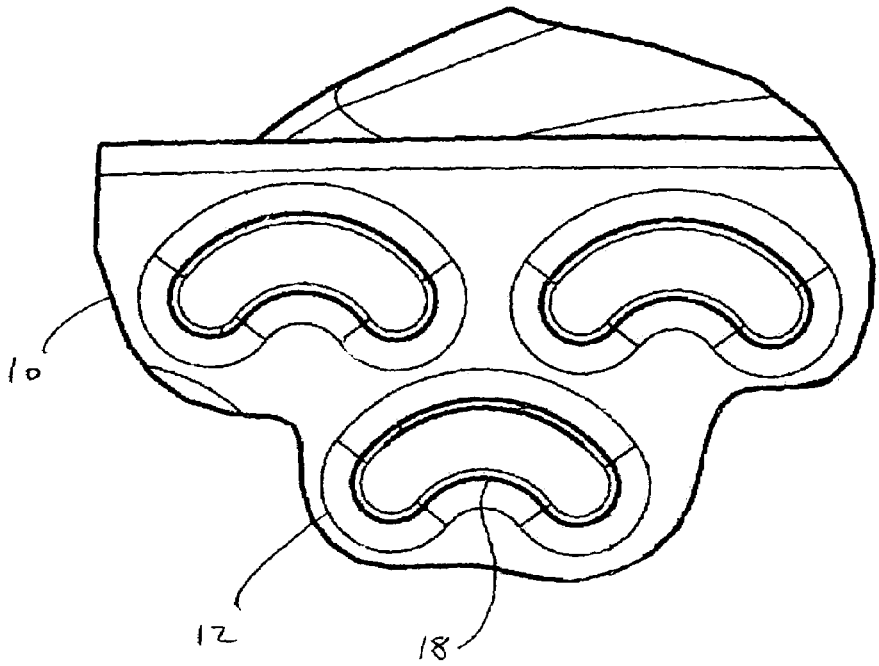
FIG. 6 is an enlarged bottom plan view of some of the bristles and a portion of the head of the basting brush of FIG. 3.

As illustrated in FIGS. 3 through 6, each bristle 12 is molded in the form of a crescent shape, that is, so as to have a crescent-shaped cross section (best illustrated in FIGS. 3 and 6). The crescent-shaped bristles provide more surface area for sauces or liquids to be captured by the brush bristles. The crescent-shaped bristles also form channels or troughs, best illustrated at 18 in FIGS. 3, 4 and 6, that permit thicker sauces and larger food particles to adhere to the bristles.

The bristles 12 of the brush may be constructed of a material having a rigidity that allows liquids and sauces to be applied to all surfaces of food, including difficult to reach cavities and crevices. As an example only, silicone bristles having a durometer of around 60 would provide suitable rigidity.

For easy cleaning of the brush, the head 10 is removable from the handle 14. More specifically, the handle 14, in the illustrated embodiment, is constructed from stainless steel wires (for example, around 4 mm in diameter) that removably engage holes formed in the head 10 in an interference fit fashion. The grip 16 may be constructed from a variety of materials and, as illustrated in FIGS. 1 and 2, includes a hole 20 for hanging the brush on a hook. As an example, the grip 16 may be made of SANTOPRENE that is molded onto, or otherwise attached to, the wire handle 14.

The brush head 10 may be molded or otherwise formed from a number of materials known in the art. For example, the head and bristles may be molded from silicone as a single piece. As another example, the head could be formed as a single piece with bristle holes formed therein and the bristles glued or otherwise secured within the bristle holes. As another example, the head could be formed of multiple pieces that are assembled with end portions of the bristles secured there between. As another example, the head, bristles, handle and grip could all be molded from a single material as a single piece.

While embodiments of the invention have been shown and described, it will be apparent to those skilled in the art that changes and modifications may be made therein without departing from the spirit of the invention.

What is claimed is:

1. A brush for basting and applying sauces to food comprising:

a) an elongated handle defining a longitudinal axis;

b) a head disposed at an end of the handle; and c) a plurality of individual bristles positioned on and extending from an end of the head such that the bristles are substantially parallel to the axis of the handle and the bristles being further arranged in rows oriented transverse to the axis; each of the bristles having a crescent-shaped cross-section defining a channel extending along the entire length thereof, each of the bristles further being oriented such that each channel is facing in the same direction.

2. The brush of claim 1 wherein said bristles are constructed of a material having a durometer of at least approximately 60.

3. The brush of claim 1 further comprising a grip positioned on said handle.

4. The brush of claim 1 wherein said handle is removable from said head.

5. The brush of claim 4 wherein said head has a hole formed therein which removably receives said handle.

6. The brush of claim 5 wherein said handle is formed from wire and said handle engages said hole in an interference-fit fashion.

7. The brush of claim 1 wherein said head and said bristles are molded as a single piece.

8. The brush of claim 7 wherein said head and bristles are molded from silicone.

9. The brush of claim 1 wherein said bristles are formed from silicone.

10. The brush of claim 9 wherein said silicone has a durometer of at least approximately 60.

* * * * *

UNITED STATES PATENT AND TRADEMARK OFFICE

CERTIFICATE OF CORRECTION

PATENT NO. : 7,373,686 B2
APPLICATION NO. : 11/385413
DATED : May 20, 2008
INVENTOR(S) : Gregory J. Foster and Robert W. Sheldon It is certified that error appears in the above-identified patent and that said Letters Patent is hereby corrected as shown below:

Title Page, Item (73) Assignee

Please delete "Radio Flyer Inc., Chicago, IL(US)" and insert -- Wilton Industries, Inc., Woodridge, IL (US) --

Signed and Sealed this

Seventh Day of July, 2009

JOHN DOLL
*Acting Director of the United States Patent and Trademark Office*